US010479081B2

(12) United States Patent
Choy

(10) Patent No.: US 10,479,081 B2
(45) Date of Patent: Nov. 19, 2019

(54) PRINTHEAD WITH FLEXIBLE SUBSTRATE

(71) Applicant: Hewlett-Packard Development Company, L.P., Houston, TX (US)

(72) Inventor: Silam J. Choy, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/748,844

(22) PCT Filed: Oct. 12, 2015

(86) PCT No.: PCT/US2015/055119
§ 371 (c)(1),
(2) Date: Jan. 30, 2018

(87) PCT Pub. No.: WO2017/065730
PCT Pub. Date: Apr. 20, 2017

(65) Prior Publication Data

US 2018/0215154 A1 Aug. 2, 2018

(51) Int. Cl.
*B41J 2/045* (2006.01)
*B41J 2/155* (2006.01)
(Continued)

(52) U.S. Cl.
CPC ..... *B41J 2/155* (2013.01); *B41J 2/0458* (2013.01); *B41J 2/04541* (2013.01);
(Continued)

(58) Field of Classification Search
CPC .. B41J 2/1753; B41J 2/17559; B41J 2/17546; B41J 2/155; B41J 2/04541; B41J 2/0458; B41J 2/04585
(Continued)

(56) References Cited

U.S. PATENT DOCUMENTS 5,153,610 A 10/1992 Komuro et al.
6,315,393 B1 11/2001 Van Nice et al.
(Continued)

FOREIGN PATENT DOCUMENTS

JP 2007196455 8/2007
WO WO-2015080730 6/2015
WO WO-2015116025 8/2015

OTHER PUBLICATIONS

Chi-Ming, H. et al.,"Design and Fabrication of the Monolithic Inkjet Print Head", Jan. 1, 2004, CPAGlobal, www.ingentaconnect.com/content/ist/nipdf/2004/00002004/0000002/art0067.

*Primary Examiner* — An H Do
(74) *Attorney, Agent, or Firm* — HP Inc. Patent Department

(57) ABSTRACT

In one example in accordance with the present disclosure a flexible printhead is described. The printhead includes a number of printhead die, a printhead die including a number of nozzles to deposit an amount of fluid onto a print medium. The printhead also includes a fluid delivery system to deliver the amount of fluid from a fluid supply to the number of nozzles. The printhead also includes a number of electrical circuits to electronically couple the number of printhead die with a printing device. The printhead also includes a flexible substrate on which the number of printhead die and the number of electrical circuits are mounted.

20 Claims, 9 Drawing Sheets

(51) Int. Cl.
*B41J 3/407* (2006.01)
*B41J 2/14* (2006.01)

(52) U.S. Cl.
CPC ..... *B41J 2/04581* (2013.01); *B41J 2/04585* (2013.01); *B41J 3/4073* (2013.01); *B41J 2002/14491* (2013.01); *B41J 2202/11* (2013.01)

(58) Field of Classification Search
USPC ..... 347/5, 9, 20, 40, 45, 50
See application file for complete search history.

(56) References Cited

U.S. PATENT DOCUMENTS

| | | | |
|---|---|---|---|
| 7,946,690 | B2 | 5/2011 | Loyer et al. |
| 8,303,087 | B2 | 11/2012 | Linliu |
| 9,162,469 | B2 * | 10/2015 | Campbell-Brown ..... B41J 2/1753 |
| 2011/0292128 | A1 | 12/2011 | McAvoy et al. |
| 2012/0186079 | A1 | 7/2012 | Ciminelli |
| 2014/0375730 | A1 | 12/2014 | Campbell-Brown et al. |

* cited by examiner

PRINTHEAD WITH FLEXIBLE SUBSTRATE

BACKGROUND

Printing systems are used to deposit printing fluid such as ink, onto a print medium such as paper. The printing system includes a fluid supply, such as an ink reservoir, that contains fluid that is eventually deposited onto the print medium. A fluid delivery system transports the printing fluid from the fluid supply to a printhead. The printhead of the printing system is the assembly that deposits the ink or other printing fluid onto the print medium.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
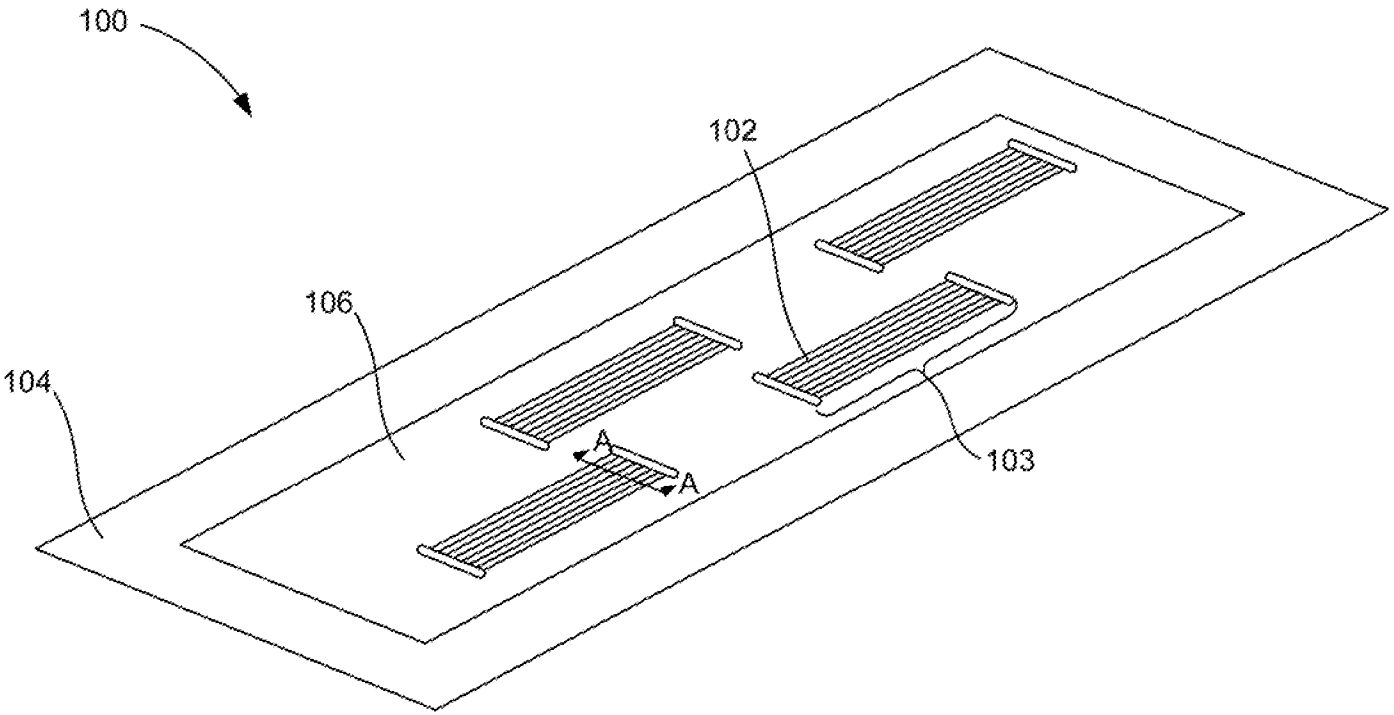
FIG. 1 is a perspective view of a printhead with a flexible substrate, according to one example of the principles described herein.

As described above, printheads are used to deliver ink, or other printing fluid, from a fluid supply reservoir onto a print medium such as paper. Other examples of print fluids include three-dimensional print agents, bio-fluids, pharmaceutical agents, etc. Other examples of print medium include three-dimensional printing medium such as powder. The printheads include printhead dies that have openings through which the printing fluid passes from the printing system onto the paper. Prior to ejection, a small amount of printing fluid resides in a firing chamber of the printhead die and an ejector such as a thermo-resistor or a piezo-resistive device creates pressure that forces a portion of the printing fluid from the firing chamber, through the opening, and onto the print medium. One particular type of printhead is a page wide printhead where an array of printhead dies spans the printing width of the print medium. While such printing systems are efficient in depositing ink, or other printing fluid, onto a print medium, some environments do not lend well to existing printing systems.

For example, many printheads are flat and are used to print on media that is held substantially flat. However, many printing systems implement non-flat media handling. For example, web presses and drum printers pass the print media over a curved surface. If a printhead has a flat printing surface but is used in non-flat media handling systems, then the width of the array in a printing direction is constrained by the curvature of the roller or drum. This constrained width may reduce the width of the individual printhead dies, the separation of the printhead dies, and the number of rows of nozzles that can be used with a printhead die, all of which reduce the efficacy of a printhead. This reduction in the number of printhead dies that can be used in non-flat media transport also reduces the number of colors that can simultaneously be deposited on the print medium.

The devices and methods of the present specification and the appended claims address these and other issues. Specifically, the present application describes a flexible printhead that includes a flexible substrate that can be formed to follow the contour of a non-flat media transport assembly such as a web press or a drum printer. In other words, a flexible printhead allows the printhead to be shaped such that it follows the contour of the media curvature, enabling either wider stance of nozzles (i.e., more nozzles, more colors, etc.) or a smaller diameter roller or drum. In another example, using a flexible substrate, the angle of different nozzles of a printhead can be changed to expel the fluid drops to different locations. For example, with a curved printhead, the angle of the nozzles can be changed such that the fluid drops land closer together, or further apart, on the print media then the corresponding distance between the nozzles.

The present specification describes a flexible printhead. The flexible printhead includes a number of printhead dies that include a number of nozzles to deposit an amount of fluid onto a print medium. The printhead also includes a fluid delivery system to deliver the amount of fluid from a fluid supply to the number of nozzles. The printhead further includes a number of electrical circuits to electronically couple the number of printhead dies with a printing device. Lastly, the system includes a flexible substrate on which the number of printhead dies and the number of electrical circuits are mounted.

The present application also describes a method for forming a printhead. According to the method, a first layer of the printhead that includes a number of printhead dies that include a number of nozzles and flexible electronic circuitry to provide electrical signals to the printhead dies is formed. The electrical signals control the ejection of fluid from the number of nozzles. A second layer of the printhead is also formed. The second layer of the printhead includes a flexible substrate on which the printhead dies and the flexible electronic circuitry are to be mounted. The first layer of the printhead and the second layer of the printhead are then attached to one another to form a flexible printhead.

The present application also describes a printhead that includes a number of nozzles in a number of printhead dies. The number of nozzles to deposit an amount of fluid onto a print medium. Each nozzle includes a firing chamber to hold the amount of fluid, an opening to dispense the amount of fluid onto the print medium, and an ejector to eject the amount of fluid through the opening. The printhead also includes a number of flexible electrical circuits to electronically couple the number of printhead dies with a printing device and a flexible substrate on which the number of printhead dies and the number of flexible electrical circuits are mounted. The flexible substrate is curved to follow a contour of a media transport assembly.

Certain examples of the present disclosure are directed to printheads and methods for forming a printhead using a flexible substrate that provides a number of advantages not previously offered including 1) allowing a printhead to follow a contour of a non-flat media transport assembly such as a web press or a drum printer; 2) increasing the printhead-print medium contact area for non-flat media printing operations; 3) increasing the efficiency of the nozzles by allowing more and wider nozzles to be used on the printhead; and 4) increasing the number of colors that can be printed at a time. However, it is contemplated that the devices and methods disclosed herein may prove useful in addressing other deficiencies in a number of technical areas. Therefore the systems and devices disclosed herein should not be construed as addressing just the particular elements or deficiencies discussed herein.

As used in the present specification and in the appended claims, the term "flexible" refers to a material that can bend, but not break for a given radius of curvature. A printhead using a flexible substrate may be less than 1 millimeter (mm) thick. The flexible substrate itself may be less than 0.5 mm. Put another way, a flexible substrate is a substrate that is not rigid.

Still further, as used in the present specification and in the appended claims, the term "a number of" or similar language is meant to be understood broadly as any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language indicates that a particular feature, structure, or characteristic described in connection with that example is included as described, but may not be included in other examples.

FIG. 1 is a perspective view of a printhead (100) with a flexible substrate (104), according to one example of the principles described herein. The printhead (100) is made up of a number of printhead dies (102) each printhead die (102) having a number of nozzles to deposit an amount of fluid onto a print medium. For simplicity a single printhead die (102) is identified with a reference number, however a printhead (100) may include any number of printhead dies (102).

The printhead (100) may be any type of printhead (100) including for example, a page-wide printhead (100) wherein the printhead is the same width, or nearly the same width of the print media in a direction perpendicular to a media transport. More specifically, given a printing page width of 8.5 inches. A page-wide printhead (100) may be 8.5 inches or slightly larger to form a border or to accommodate components at the peripheries of the printhead (100). A page-wide printhead (100) alleviates lateral movement of either the print medium or the printhead (100) when depositing printing fluid onto the print medium. This reduces the likelihood of breakdown due to the mechanical devices that would otherwise be used to move the printhead (100). The examples shown in the corresponding figures are not meant to limit the present description. Instead, various types of printheads (100) may be used in conjunction with the principles described herein. Moreover, while FIG. 1 depicts a number of printhead dies (102) grouped together, and four printhead die groups (103), any number of printhead die (102) constructions and configurations can be implemented in line with the present disclosure.

Figure 2:
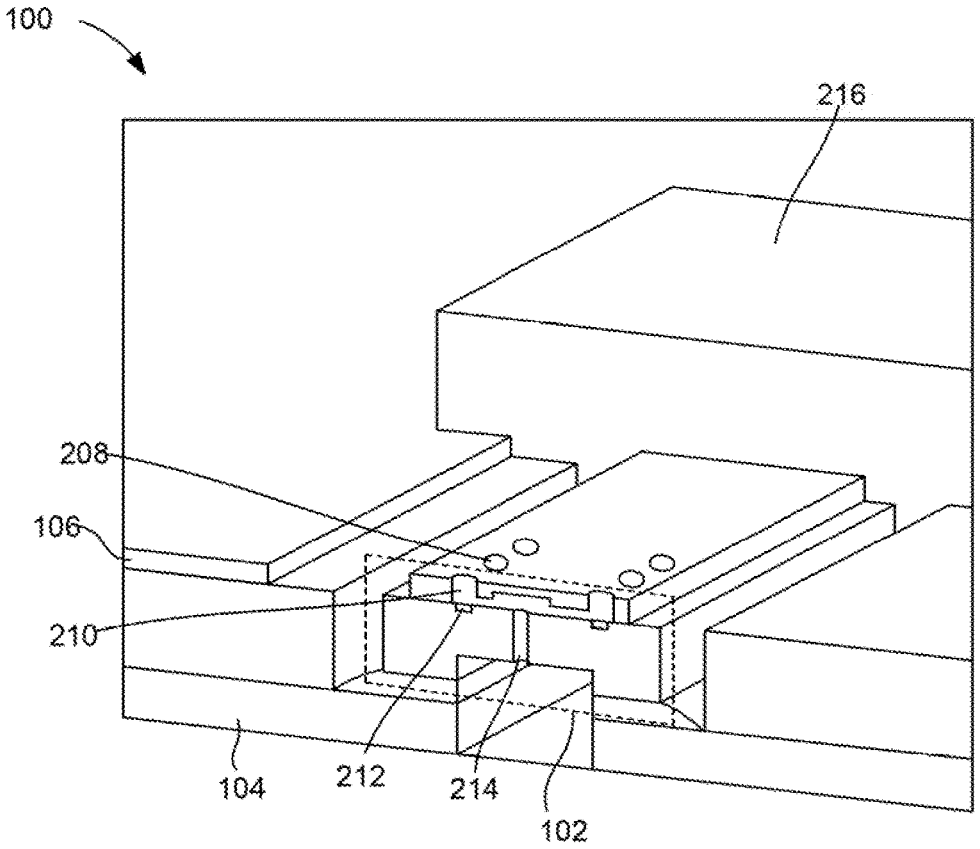
FIG. 2 is a cross-sectional perspective view of a printhead with a flexible substrate, according to one example of the principles described herein.

The printhead (100) includes a number of components for depositing a fluid onto a surface. For example, the printhead dies (102) of the printhead (100) include a number of nozzles. For simplicity the nozzles of the printhead dies (102) are illustrated in FIG. 2. The nozzles of the printhead dies (102) may be arranged in columns or arrays such that properly sequenced ejection of fluid from the nozzles causes characters, symbols, and/or other graphics or images to be printed on the print medium. In one example, the number of nozzles fired may be a number less than the total number of nozzles available and defined on the printhead (100).

In an example where the fluid is an ink, a first subset of nozzles may eject a first color of ink while a second subset of nozzles may eject a second color of ink. Additional groups of nozzles may be reserved for additional colors of ink. To create an image, at appropriate times, electrical signals passed to the printhead (100) cause the printhead (100) to eject small droplets of fluid from the nozzles onto the surface of the print medium. The electrical signals are passed to the printhead dies (102) from a flexible electrical circuit (106), which as shown in FIG. 1, may be a film. Specifically, the flexible electrical circuit (106) may be formed as a film substrate with patterned metallic traces. The metallic traces are attached to the film substrate with or without adhesive. An additional layer may be placed on top of the film substrate and metallic traces to protect the traces from environmental contaminants such as ink.

Returning to the fluidic ejection, the droplets of fluid combine to form an image on the surface of the print medium. As used in the present specification and in the appended claims, the print medium may be any type of suitable sheet or roll material, such as paper, card stock, transparencies, polyester, plywood, foam board, fabric, canvas, and the like. In another example, the print medium may be an edible substrate.

The printhead dies (102) are mounted onto a flexible substrate (104). As will be described in FIG. 2, the electrical circuits (106) connecting the printhead dies (102) to a printing device are also mounted on the flexible substrate (104). The flexible substrate (104) is any substrate that bends without breaking for a given radius of curvature. For example, when used with a non-flat media transport assembly such as a web press or a drum printer, the flexible substrate (104) bends to conform to the contour of the web press or drum printer. So doing allows for a greater contact area between the printhead (100) and the media transport assembly, which greater contact area allows for wider printhead dies (102) or more printhead dies (102), i.e., nozzles, to be used on the printhead (100).

While the flexible substrate (104) allows for a printhead (100) that can be formed to a curved, or other non-flat shape, the flexible substrate (104) is not so flexible as to compromise the robustness of the printhead (100). In other words, the flexible substrate (104) provides some flexibility to the printhead (100) while also providing a surface on which components of the printhead (100) are mounted. As noted, the substrate (104) on which the printhead (100) and printhead dies (102) are formed is flexible. In these examples, the printhead (100) and printhead dies (102) themselves may or may not be flexible. Moreover, the flexible substrate (104) retains the printhead (100) and printhead dies (102) even during the execution of a printing operation. In other words, the flexible substrate (104) is not discarded prior to operation of the printhead (100) and printhead dies (102).

The flexible substrate (104) may be formed of a variety of materials. For example, the flexible substrate (104) may be formed of a metallic foil, a ceramic foil, and polymeric foils, among other flexible material. The flexible substrate (104) is also sufficiently thin to allow for such flexibility. For example, the flexible substrate may be less than a half a millimeter in thickness. As a specific example, the flexible substrate (104) may be a stainless steel foil that is between 50-100 microns thick. Stainless steel, or another metallic material, allow for increased thermal conductivity. A flexible substrate (104) as described herein allows for greater flexibility in designing a printhead (100) for use with various non-flat media transport assemblies.

FIG. 2 is a cross-sectional perspective view of a printhead (100) with a flexible substrate (104), according to one example of the principles described herein. More specifically, FIG. 2 is a portion of sectional view taken along the portion of the plane indicated by the line "A" identified in FIG. 1. As described above, the printhead (100) may include a number of printhead dies (102). For simplicity in FIG. 2, a single printhead die (102) is indicated with a reference number, but multiple printhead dies (102) may be present in a printhead (100). A printhead die (102) includes a number of nozzles to deposit an amount of fluid onto a print medium. The nozzles may be arranged in rows, columns, or other forms of arrays to deposit the fluid onto a print medium. The printhead die (102) also includes a firing chamber (210) in fluid communication that holds an amount of fluid to be dispensed through an opening (208) of the nozzle.

The printhead die (102) also includes an ejector (212) to eject the amount of fluid through the opening (208). The ejector (212) may include a firing resistor or other thermal device, a piezoelectric element, or other mechanism for ejecting fluid from the firing chamber (210). For example, the ejector (212) may be a firing resistor. The firing resistor heats up in response to an applied voltage. As the firing resistor heats up, a portion of the fluid in the firing chamber (210) vaporizes to form a bubble. This bubble pushes liquid fluid out the opening (208) and onto the print medium. As the vaporized fluid bubble pops, a vacuum pressure within the firing chamber (210) draws fluid into the firing chamber (210) from the fluid supply, and the process repeats. In this example, the printhead (100) may be a thermal inkjet printhead (100).

In another example, the ejector (212) may be a piezoelectric device. As a voltage is applied, the piezoelectric device changes shape which generates a pressure pulse in the firing chamber (210) that pushes a fluid out the opening and onto the print medium. In this example, the printhead (100) may be a piezoelectric inkjet printhead. The printhead (100) also includes a fluid delivery system (214) to deliver an amount of fluid from a fluid supply to the number of opening (208). The fluid delivery system (214) may include a channel that passes from the backside of the printhead die (102) to the opening (208) which are disposed on a front side of the printhead die (102).

In some examples, the printhead dies (102) are sliver dies that are thin, for example less than 200 microns thick and that are narrow, for example between 100 and 1,000 microns wide. In addition to the flexible substrate (104) described below, the sliver dies may allow for a tighter radius of curvature for the printhead (100) such that the printhead (100) may be easily used in conjunction with non-flat media transport assemblies.

FIG. 2 also depicts the electrical circuits (106) that are used to electronically couple the printhead die (102) with a printing device. For example, the printing device, such as a printer, receives from a computing device an image or text to be printed. The printer then sends electrical signals via the electrical circuits (106) to the printhead die (102) to control the ejection of fluid through the opening (208) to form the image or text. For example, the electrical circuits (106) may deliver a voltage that activates the ejector (323) to dispel fluid from the firing chamber (210) through the opening (208).

Via the electrical circuits (106) other control information may similarly be passed to the printhead die (102). In some examples, via the electrical circuits (106), information is passed from the printhead die (102) to the printing device communicating such information as nozzle health, fluid health, and other status information or data regarding the components of the printhead die (102). As described above, the flexible electrical circuit (106) may be formed as a film substrate with patterned metallic traces.

The electrical circuits (106) may include an electrical interconnect, such as a solder bump wherein the electrical circuit (106) is electrically coupled to the printhead die (102). To protect the connection between the flexible electrical circuit (106) and the printhead dies (102) through which information is passed, an encapsulant (216) is placed over the electrical interconnect. Specifically, the encapsulant (216) is placed over an electrical interconnect between the printhead die (102) and the electrical circuit (106) to prevent separation of the electrical connection between the printhead die (102) and the flexible electrical circuits (106). As with the substrate (104) and the electrical circuits (106) the encapsulant (216) and encapsulant adhesive may also be flexible.

As described above, the printhead die (102) and the electrical circuits (106) are mounted to the flexible substrate (104). Specifically, the printhead die (102) and the electrical circuitry (106) may be attached to the flexible substrate (104) via adhesive components.

As described above, the flexible substrate (104) is formed of a material that allows the flexible substrate (104) to bend without breaking for a particular radius of curvature. For example, the flexible substrate (104) may be thin enough such that it may have a particular radius of curvature to match a contour of a media transport assembly such as a web press or a drum printer. The flexible substrate (104) and thin printhead dies (102) may allow for a printhead (100) such as a page wide printhead to be shaped to match the contour of a media transport assembly. Moreover, the thinness of the printhead (100) enables this shaping to be carried out without damage to the printhead (100) or printhead dies (102).

Still further, the flexible printhead (100) allows for a greater contact area between the non-flat media transport assembly and the printhead nozzles. Moreover, as the printhead (100) is flexible, the same printhead (100) could be mounted on different shaped carriers to match differently shaped media transport assemblies.

Figure 3:
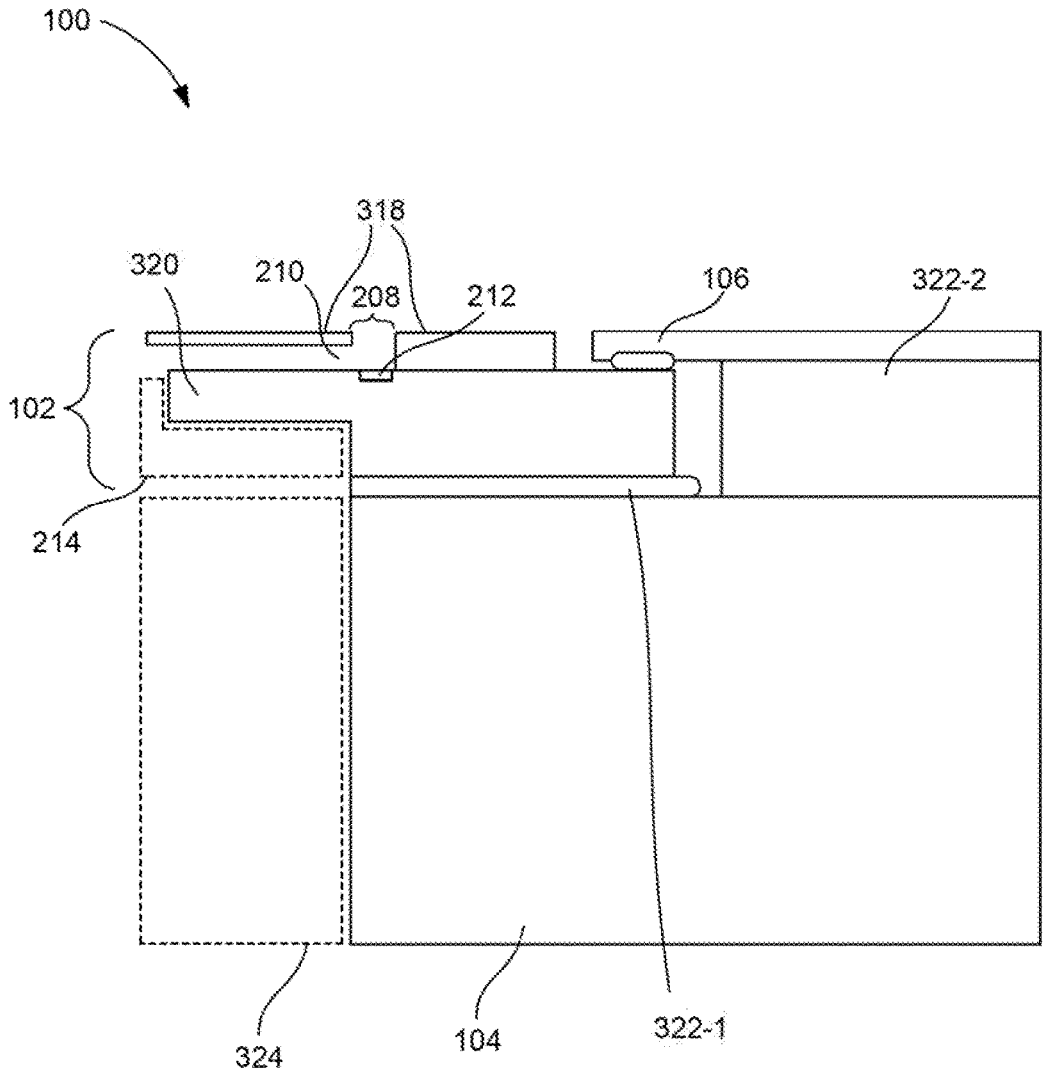
FIG. 3 is a cross-sectional side view of a printhead with a flexible substrate, according to one example of the principles described herein.

FIG. 3 is a cross-sectional side view of a printhead (100) with a flexible substrate (104), according to one example of the principles described herein. More specifically, FIG. 3 is a side view of a portion of the view depicted in FIG. 2. As described above, a printhead die (102) includes a number of nozzles to deposit an amount of fluid onto a print medium. The printhead die (102) may include multiple layers. For example, the printhead die (102) may include an epoxy, or other first layer (318) that forms some of the components of the printhead die (102). For example, the geometry of the first layer (318) may define a firing chamber (210) where fluid that is to be ejected is stored until ejection. The first layer (318) also defines the opening (208) through which the amount of fluid is deposited onto the print medium.

The printhead die (102) also includes a die substrate (320). The die substrate (320) may be formed of silicon and may hold components used during fluidic ejection. For example, the die substrate (320) may be a semiconductor substrate and may include circuitry and transistors. The die substrate (320) may include an ejector (212) for ejecting fluid through the opening (208) from the firing chamber (210). The printhead die (102) also defines a fluid delivery system (214), to deliver an amount of fluid from a fluid supply to the number of openings (208). FIG. 3 also depicts the electrical circuit (106) that electronically couples the printhead die (102) with a printing device.

As described above, the printhead die (102) and the electrical circuits (106) are mounted to the flexible substrate (104). Specifically, the printhead die (102) and the electrical circuitry (106) may be attached to the flexible substrate (104) via adhesive components (322-1, 322-2).

To allow fluid such as ink to flow from an ink tank to the printhead die (102), the flexible substrate (104) has a channel (324). The channel (324) may be chemically etched or mechanically etched from the flexible substrate (104). Examples of mechanical etching include sand blasting and using a water jet. The channel (324) may also be formed using a laser, saw mills, and end blades among other mechanical etching tools.

Certain flexible substrate (104) materials, such as metallic foils lend to precise chemical etching. Thus the channel (324) may be etched into the flexible substrate (104) without causing damage to other components, or the substrate itself. In some examples, the channel (324) is etched prior to mounting the printhead die (102) to the flexible substrate (104) and in other examples is formed after mounting the printhead die (102) to the flexible substrate (104). Forming the channel (324) after mounting simplifies the mounting process as it alleviates a complex alignment between the channel (324) and the printhead die (102) fluid delivery system (214) as the channel (324) has not yet been formed.

Figure 4:
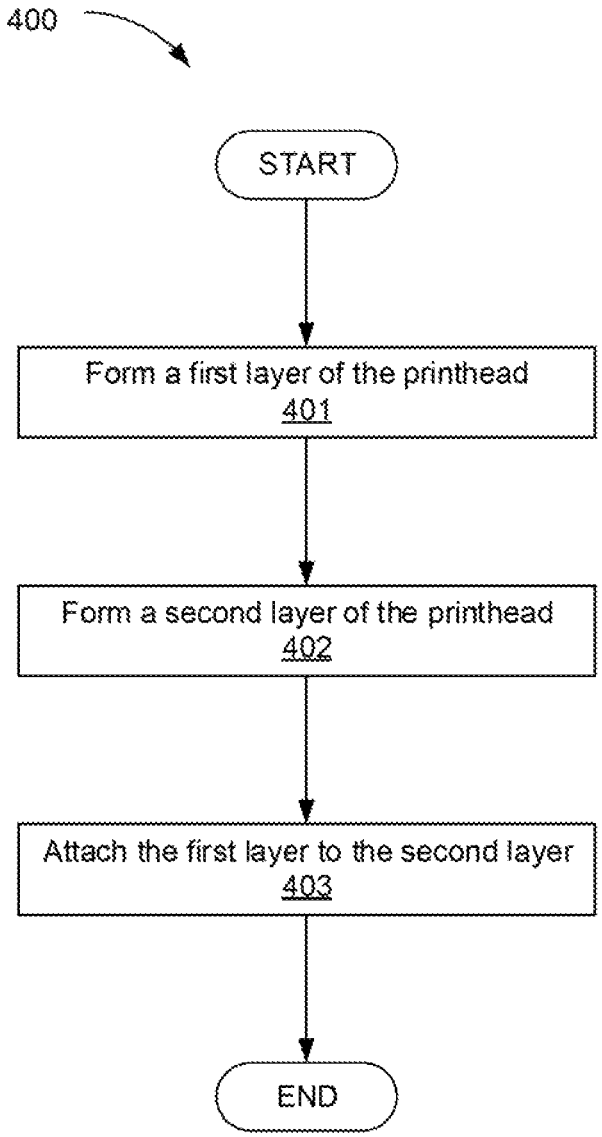
FIG. 4 is a flowchart of a method of forming a printhead with a flexible substrate, according to one example of the principles described herein.

FIG. 4 is a flowchart of a method (400) of forming a printhead (FIG. 1, 100) with a flexible substrate (FIG. 1, 104), according to one example of the principles described herein. According to the method (400), a first layer of the printhead (FIG. 1, 100) is formed (block 401). The first layer of the printhead (FIG. 1, 100) includes the printhead die (FIG. 1, 102) and the flexible electronic circuitry (FIG. 1, 106) that provides electrical signals to and from the printhead die (FIG. 1, 102). A second layer of the printhead (FIG. 1, 100) is also formed (block 402). The second layer of the printhead (FIG. 1, 100) includes the flexible substrate (FIG. 1, 104) on which the printhead die (FIG. 1, 102) and the flexible electronic circuitry (FIG. 1, 106) are to be mounted. After both layers have been formed, the first layer is attached to the second layer, thus forming (block 403) the flexible printhead (FIG. 1, 100). FIGS. 5A-5F illustrate these operations.

Figure 5A:
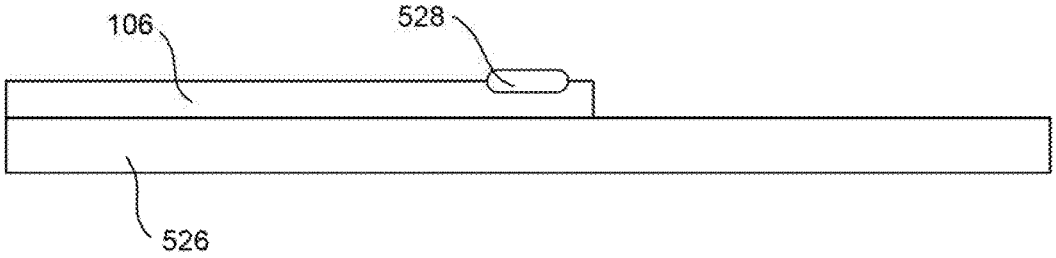
FIGS. 5A-5F are diagrams of the formation of a printhead with a flexible substrate as described in FIG. 4, according to one example of the principles described herein.

More specifically, FIGS. 5A-5F are diagrams of the formation of a printhead (FIG. 1, 100) with a flexible substrate (FIG. 1, 104), according to one example of the principles described herein. As depicted in FIG. 5A, the flexible electronic circuitry (106) is positioned on a release substrate (526). For example, the flexible electronic circuitry (106) may be positioned on thermal release tape. In addition to positioning the flexible electronic circuitry (106) on the release substrate (526), an electrical interconnect (528) between the printhead die (FIG. 1, 102) and the flexible circuitry (106) is deposited. The electrical interconnect (528) ensures that signals flowing along the flexible electrical circuitry (106) are passed to the printhead die (FIG. 1,102). The electrical interconnect (528) may take any form including a solder bump, via thermocompression bonding, or wire bonding, a conductive adhesive and an anisotropically conductive adhesive among other electrical connection methods.

Figure 5B:
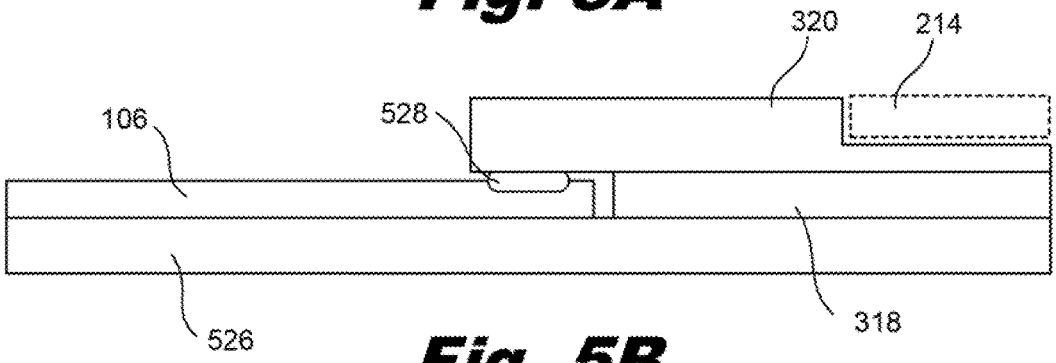

As depicted in FIG. 5B, the printhead die (FIG. 1, 102), specifically, the first layer (318) which may be an epoxy layer, and the die substrate (320), which is a semiconductive carrier for different components of the printhead die (FIG. 1, 102) are deposited on the release substrate (526). A portion of the fluid delivery system (214) of the printhead die (102) is also depicted in FIG. 5B. The electrical interconnect (528) is then activated by applying heat and or pressure to the electrical interconnect (528) thus establishing the electrical connectivity of the printhead die (FIG. 1, 102) and the electrical circuitry (106). Together the die substrate (320), the first layer (318), electrical interconnect (528), and the flexible electronic circuit (106) comprise the first layer of the printhead (FIG. 1, 100).

Figure 5C:
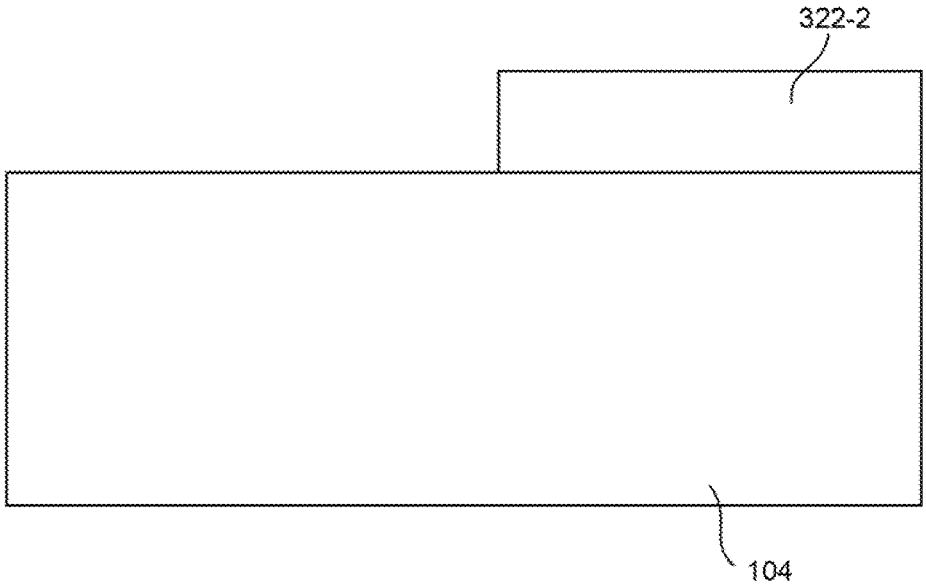

In a different operation indicated in FIG. 5C, a circuit adhesive (322-2) is placed on a portion of a surface of the flexible substrate (104) that will receive the flexible electronic circuitry (106). At this point, the flexible substrate (104) may be milled to form the channel (FIG. 3, 324) through which the print fluid passes from the fluid supply to the printhead die (FIG. 1, 102). Specifically a channel (FIG. 3, 324) that directs fluid to the nozzle of the printhead die (FIG. 1, 102) to be ultimately ejected onto the print medium. In other operations, the channel (FIG. 3, 324) is formed after the joining (block 403) of the first layer and the second layer.

Figure 5D:
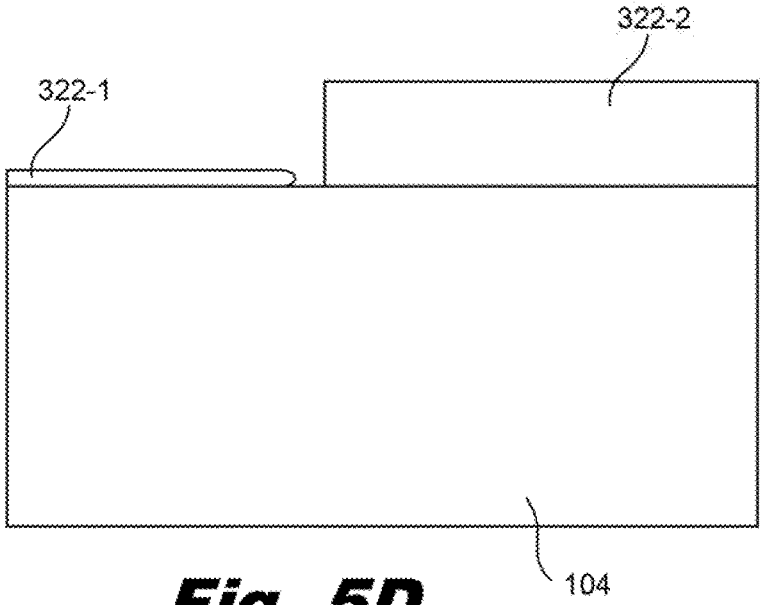

As depicted in FIG. 5D, a die adhesive (322-1) is attached to the flexible substrate (104). This die adhesive (322-1) is an adhesive that binds the printhead die (FIG. 1, 102) to the flexible substrate (104). The die adhesive (322-1), similar to the substrate and circuitry, may be flexible. The die adhesive (322-1) may be stamp transferred, needle dispensed, jet dispensed, or placed as a pattern among other placement methods to the flexible substrate (104).

Figure 5E:
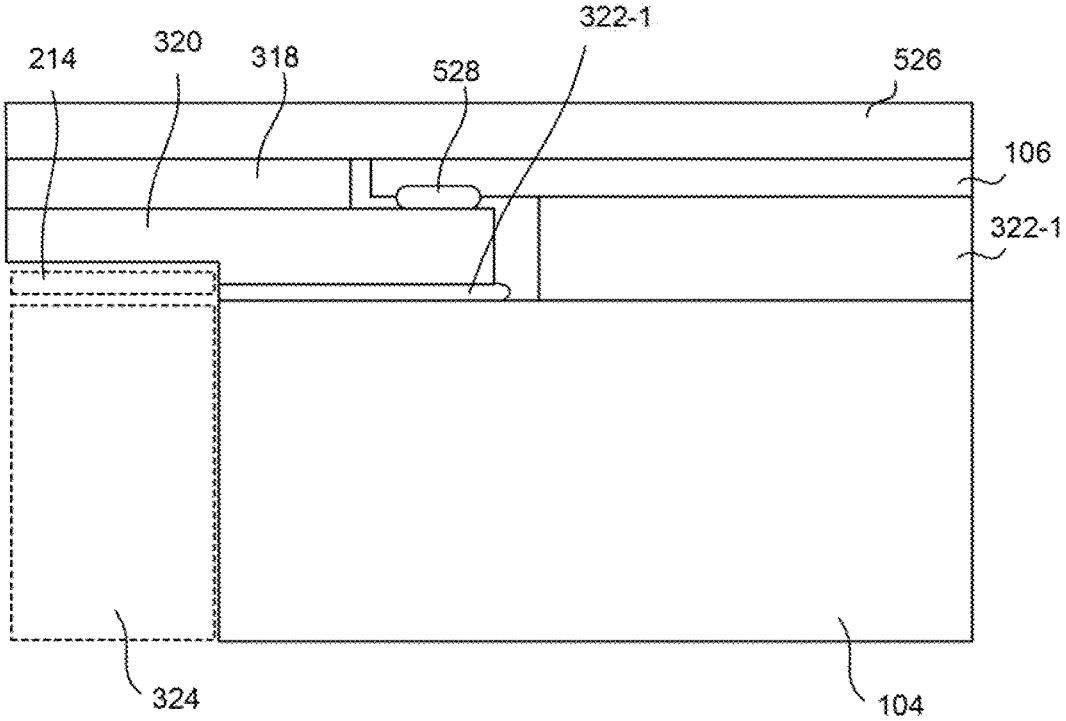

In FIG. 5E, the first layer of the printhead (FIG. 1, 100), i.e., the flexible electrical circuitry (106), electrical interconnect (528), die substrate (320), and first layer (318) that are disposed on the release substrate (526), is joined to the second layer of the printhead (FIG. 1, 100) that includes the flexible substrate (104) and the corresponding adhesive layers (322-1, 322-1). In joining the two layers, the first layer may be picked and placed directly on the second layer or may be placed on an intermediate carrier panel. Again, while FIG. 5E depicts the fluid delivery system (214) and the channel (324) formed prior to joining, the channel (324) may be formed after the joining.

Figure 5F:
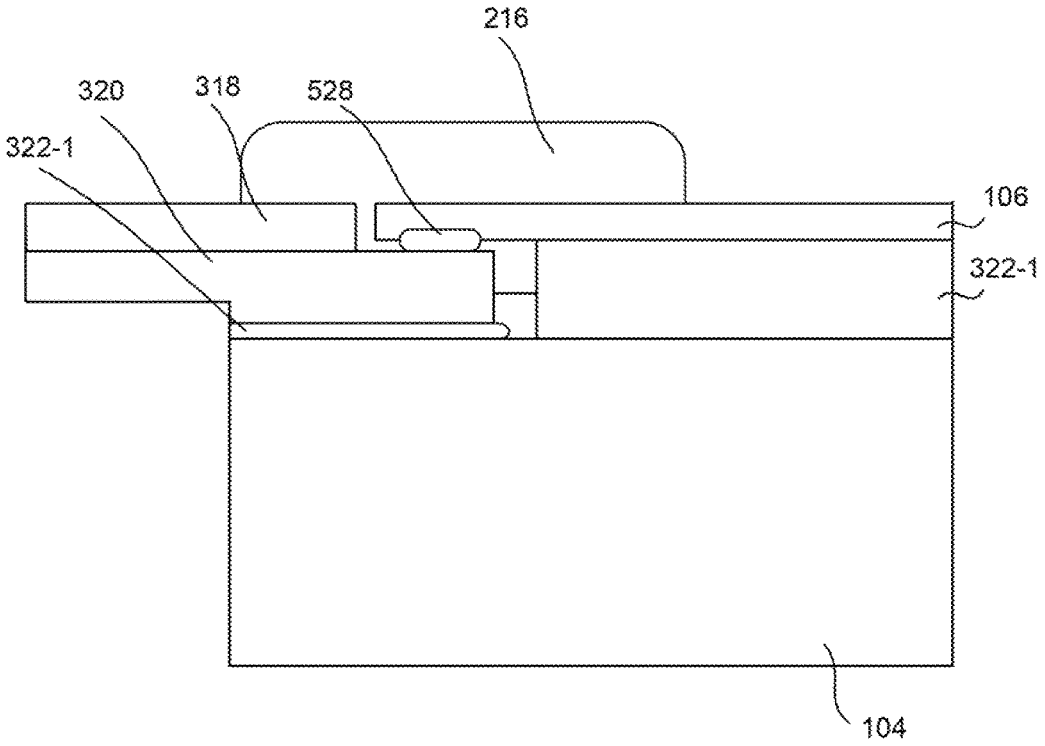

The joining of the first layer and the second layer may include curing the adhesives (322-1, 322-2) at high pressure and temperature. After curing the adhesives (322-1, 322-2), the release substrate (526) is removed from the printhead (FIG. 1, 100) and an encapsulant (216) placed over the flexible electronic circuitry (106) and a portion of the printhead die (FIG. 1, 102) as depicted in FIG. 5F. Specifically, the encapsulant (216) is placed over the electrical interconnect (528) to protect it and prevent separation of the electrical connection.

Figure 6:
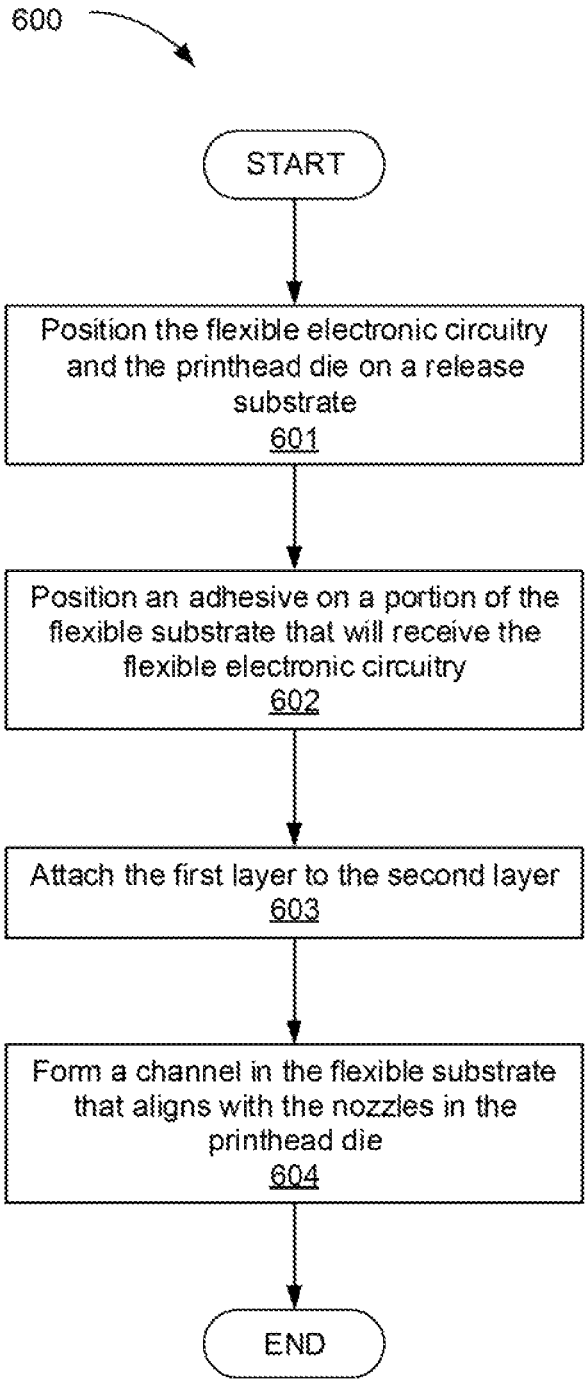
FIG. 6 is a flowchart of a method of forming a printhead with a flexible substrate, according to another example of the principles described herein.

FIG. 6 is a flowchart of a method (600) of forming a printhead (FIG. 1, 100) with a flexible substrate (FIG. 1, 104), according to another example of the principles described herein. According to the method, the flexible electronic circuitry (FIG. 1, 106) and the printhead die (FIG. 1, 102) are positioned (block 601) on a release substrate (FIG. 5, 526) as depicted in FIGS. 5A and 5B. These components, i.e., the printhead die (FIG. 1,102), the flexible electronic circuitry (FIG. 1, 106) and supporting components form the first layer of the printhead (FIG. 1, 102). Next, a circuit adhesive (FIG. 3, 322-2) is positioned (block 602) on a portion of the flexible substrate (FIG. 1, 104) that will receive the flexible electronic circuitry (FIG. 1, 106) as depicted in FIG. 5C. These components, i.e., the circuit adhesive (FIG. 3, 322-2) and the flexible circuit (FIG. 1, 104) form the second layer of the printhead (FIG. 1, 102). The first layer of the printhead (FIG. 1, 102) is then attached (block 603) to the second layer of the printhead (FIG. 1, 102) as illustrated in FIG. 5E.

The method (600) also includes forming (block 604) a channel (FIG. 3, 324) in the flexible substrate (FIG. 1, 104) that aligns with the fluid delivery system (FIG. 2, 214) and nozzles in the printhead die (FIG. 1, 102) to facilitate ink flow from a fluid supply to the number of nozzles. For example, in some cases, the fluid supply may be separated from the printhead die (FIG. 1, 102). According, fluid is directed from the fluid supply, through the channel (FIG. 3, 324) through the fluid delivery system (FIG. 2, 214) of the printhead die (FIG. 1, 102) to the openings (FIG. 2, 208). Forming (block 604) the channel (FIG. 3, 324) may include chemically etching the flexible substrate (FIG. 1, 104) to form the channel (FIG. 3, 324). Chemical etching may include photo etching. Photo etching may be efficient as a batch process for forming many channels (FIG. 3, 324) in the flexible substrate (FIG. 1, 104) to align with the many printhead dies (FIG. 1, 102) that may be present on a printhead (FIG. 1, 100). Moreover, such chemical etching of flexible substrate (FIG. 1, 104) materials such as metal and certain polymers can be executed precisely with photo-defined masks without damaging any components within the silicon die substrate (FIG. 3, 320).

In some examples, for example as depicted in FIGS. 5A-5F, the channel (FIG. 3, 324) may be formed before mounting the printhead die (FIG. 1, 102) and the flexible electronic circuitry (FIG. 1, 106) to the flexible substrate (FIG. 1, 104). However, in other examples, the channel (FIG. 3, 324) is formed after the printhead die (FIG. 1, 102) and the flexible electronic circuitry (FIG. 1, 106) is mounted, thus avoiding the complex alignment of a channel (FIG. 3, 324) with the fluid delivery system (FIG. 2, 214).

Figure 7:
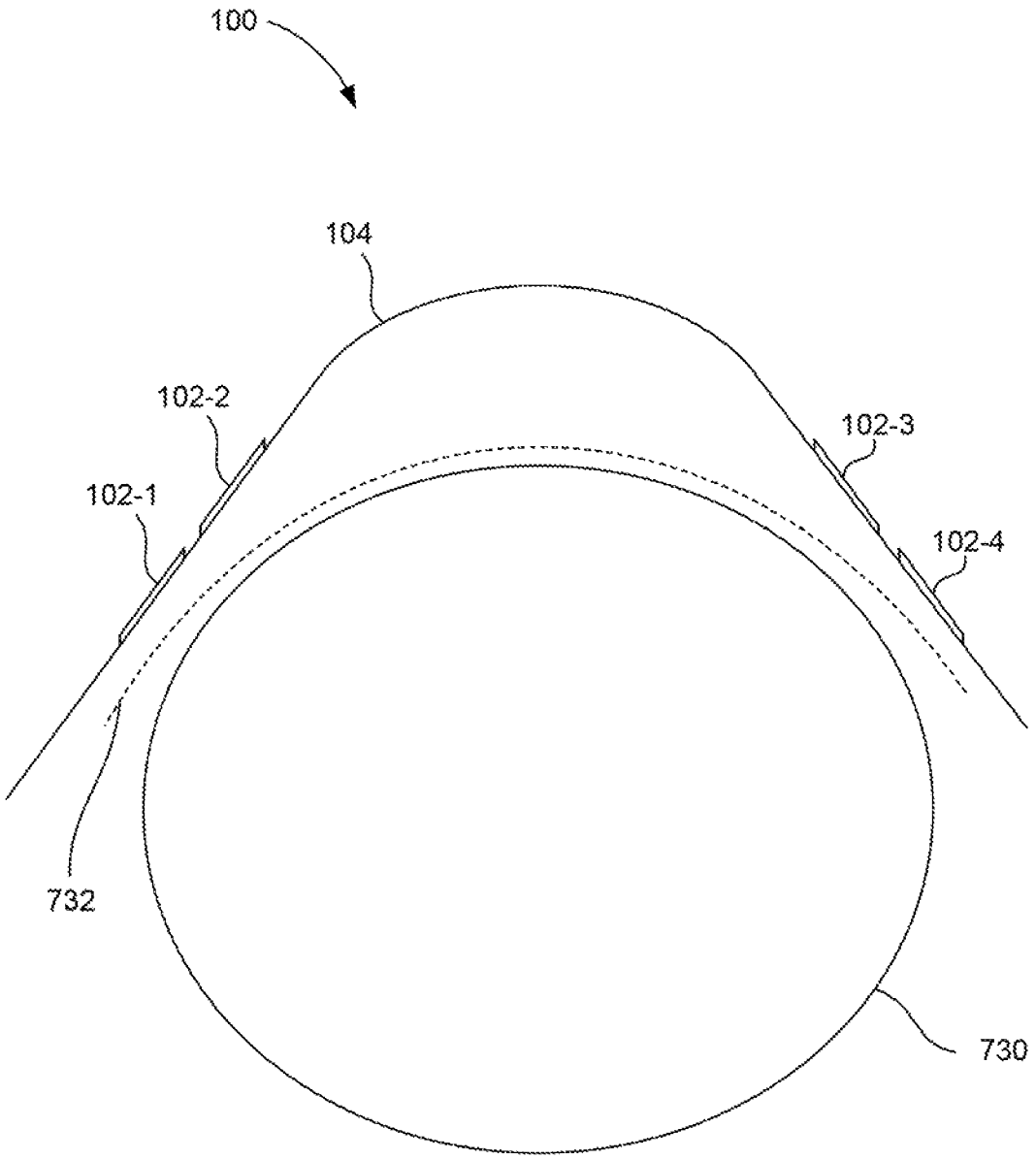
FIG. 7 is a cross-sectional side view of a curved printhead with a flexible substrate, according to one example of the principles described herein.

FIG. 7 is a cross-sectional side view of a curved printhead (100) with a flexible substrate (104), according to one example of the principles described herein. As described throughout this specification, a flexible substrate (104) allows for a curved printhead (100) to be used to accommodate non-flat media transport assemblies (730). For example, in use, a non-flat media transport assembly (730) such as a drum printer may pass paper around its circumference as indicated by the dashed line (732). In this example, the printhead (100) with the flexible substrate (104) can be shaped to obtain a desired radius of curvature to match the circumference of the non-flat media transport assembly (730). In this fashion more printheads (102-1, 102-2, 102-3, 102-4) are in proximity to the media such that more printheads can deposit printing fluid such as ink onto the surface of the print media. While FIG. 7 specifically depicts a round media transport assembly (730), the flexible printhead (100) may be shaped to match the contour of any non-flat media transport assembly (730), and not just round media transport assemblies (730).

While FIG. 7 depicts a specific example where the printhead (100) is curved, in another example using a flexible substrate (104), the angle of different nozzles of a printhead (100) can be changed to expel the fluid drops to different locations. For example, the angle of the nozzles can be changed such that the fluid drops land closer together, or further apart, on the print media then the corresponding distance between the nozzles.

Certain examples of the present disclosure are directed to printheads and methods for depositing a printing fluid onto a print medium using a flexible substrate that provides a number of advantages not previously offered including 1) allowing a printhead to follow a contour of a non-flat print transport assembly such as a web press or a drum printer; 2) increasing the printhead-print medium contact area for non-flat printing media handling operations; 3) increasing the efficiency of the nozzles by allowing more and wider nozzles to be used on the printhead; and 4) increasing the number of colors that can be printed at a time. However, it is contemplated that the devices and methods disclosed herein may prove useful in addressing other deficiencies in a number of technical areas. Therefore the systems and devices disclosed herein should not be construed as addressing just the particular elements or deficiencies discussed herein.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printhead comprising:

multiple printhead dies, the printhead dies comprising a number of nozzles to deposit an amount of fluid onto a print medium;

a fluid delivery system to deliver the amount of fluid from a fluid supply to the number of nozzles;

a number of electrical circuits to electronically couple the multiple printhead dies with a printing device; and a flexible substrate on which the multiple printhead dies and the number of electrical circuits are mounted, wherein the flexible substrate is curved to follow a contour of a media transport assembly.

2. The printhead of claim 1, wherein the flexible substrate is at least one of a metallic material, a ceramic material, and a polymeric material.

3. The printhead of claim 1, wherein the flexible substrate has a radius of curvature to match a contour of a media transport assembly.

4. The printhead of claim 1, wherein the flexible substrate is less than a half a millimeter thick.

5. The printhead of claim 1, wherein the printhead is a page-wide printhead.

6. The printhead of claim 1, wherein the multiple printhead dies are sliver dies between 100 and 1,000 microns wide.

7. The printhead of claim 1, further comprising a film substrate in which the number of electrical circuits are formed as patterned metallic traces.

8. The printhead of claim 1, wherein a radius of curvature of the flexible substrate matches a web press or a drum printer.

9. The printhead of claim 1, wherein the media transport assembly is round.

10. A method for forming a printhead comprising:

forming a first layer of the printhead, the first layer comprising:

a printhead die that includes a number of nozzles; and flexible electronic circuitry to provide electrical signals to the printhead die, the electrical signals to control ejection of fluid from the number of nozzles;

forming a second layer of the printhead, the second layer comprising a flexible substrate on which the printhead die and the flexible electronic circuitry are to be mounted; and attaching the first layer of the printhead to the second layer of the printhead to form a flexible printhead.

11. The method of claim 10, wherein:

forming the first layer of the printhead comprises positioning the flexible electronic circuitry and the printhead die on a release substrate; and forming the second layer of the printhead comprises positioning a circuit adhesive on a portion of a surface of the flexible substrate that will receive the flexible electronic circuitry.

12. The method of claim 10, further comprising forming a channel in the flexible substrate that aligns with the nozzles in the printhead die to facilitate fluid flow from a fluid supply to the number of nozzles.

13. The method of claim 12, wherein forming the channel in the flexible substrate comprises chemically etching the flexible substrate to form the channel.

14. The method of claim 12, wherein forming the channel in the flexible substrate comprises mechanically removing material from the flexible substrate to form the channel.

15. The method of claim 12, wherein the channel in the flexible substrate is formed after the first layer of the printhead is attached to the second layer of the printhead.

16. The method of claim 10, wherein attaching the first layer of the printhead to the second layer of the printhead comprises curing an adhesive between the first layer of the printhead and the second layer of the printhead.

17. A printhead comprising:

a number of nozzles in a printhead die, the number of nozzles to deposit an amount of fluid onto a print medium, each nozzle comprising;

a firing chamber to hold the amount of fluid;

an opening to dispense the amount of fluid onto the print medium; and an ejector to eject the amount of fluid through the opening;

a number of flexible electrical circuits to electronically couple the printhead die with a printing device; and a flexible substrate on which the printhead die and the number of flexible electrical circuits are mounted, wherein the flexible substrate is curved to follow a contour of a media transport assembly.

18. The printhead of claim 17, wherein an angle of the openings in a printhead die are such that fluid drops ejected from the openings are closer or farther apart on the print media then the corresponding distance between the openings.

19. The printhead of claim 17, wherein the flexible substrate is a stainless steel foil less than 100 microns thick.

20. The printhead of claim 17, wherein the flexible substrate has a radius of curvature to match the contour of the media transport assembly.

* * * * *